US009926721B2

(12) United States Patent
Niekamp

(10) Patent No.: US 9,926,721 B2
(45) Date of Patent: Mar. 27, 2018

(54) POST DRIVER APPARATUS

(71) Applicant: Danuser LLC, Fulton, MO (US)

(72) Inventor: Gary J. Niekamp, Jefferson City, MO (US)

(73) Assignee: Danuser LLC, Fulton, MO (US)

( * ) Notice: Subject to any disclaimer, the term of this patent is extended or adjusted under 35 U.S.C. 154(b) by 615 days.

(21) Appl. No.: 14/595,992

(22) Filed: Jan. 13, 2015

(65) Prior Publication Data

US 2016/0201353 A1 Jul. 14, 2016

(51) Int. Cl.

| | |
|---|---|
| ***E04H 17/26*** | (2006.01) |
| ***B25D 9/12*** | (2006.01) |
| ***E02D 7/06*** | (2006.01) |

(52) U.S. Cl.

CPC ..... *E04H 17/263* (2013.01); *B25D 9/12* (2013.01); *E02D 7/06* (2013.01); *B25D 2211/003* (2013.01); *B25D 2250/351* (2013.01); *B25D 2250/371* (2013.01)

(58) Field of Classification Search

CPC ..... B25D 9/00; B25D 9/12; E04H 17/263
USPC ..... 173/90–91, 93, 115, 129
See application file for complete search history.

(56) References Cited

U.S. PATENT DOCUMENTS 1,859,398 A * 5/1932 Judd ..... E04H 17/263 173/118
2,055,001 A * 9/1936 Blomquist ..... B25D 11/10 173/140
2,407,444 A * 9/1946 Pfingsten ..... E04H 17/263 173/126
2,998,087 A * 8/1961 Iddings ..... E02D 7/04 173/102
3,205,952 A * 9/1965 Sicotte ..... E02D 7/04 173/124
3,504,750 A * 4/1970 Rouviere ..... E21B 25/00 175/244
3,792,739 A * 2/1974 Deike ..... B25D 1/16 173/118
4,405,020 A * 9/1983 Rassieur ..... E02D 7/08 173/124
5,497,555 A * 3/1996 Averbukh ..... B25D 11/064 173/117

(Continued)

*Primary Examiner* — Thanh Truong
*Assistant Examiner* — Nicholas Igbokwe
(74) *Attorney, Agent, or Firm* — Joseph M. Rolnicki; Evans & Dixon, L.L.C.

(57) ABSTRACT

This disclosure pertains to a post driver apparatus of simplified and compact construction. The apparatus can be easily attached to a vehicle equipped with a universal quick attach hitch and having auxiliary hydraulics, for example a farm or construction vehicle. The apparatus includes a hydraulic motor that is driven by the auxiliary hydraulics of the vehicle to which the apparatus is attached. The hydraulic motor rotates a drive wheel of the apparatus which is operatively connected with a weight piston of the apparatus. Rotation of the drive wheel lifts and then drops the weight piston on each rotation of the drive wheel. With the apparatus positioned on the top end of a post, each time the weight piston is dropped it impacts the top of the post and drives the post downwardly. The apparatus is equipped with a safety feature that prevents rotation of the drive wheel from operatively raising the weight piston until the apparatus is positioned on top of a post and exerts a force on the top end of the post.

18 Claims, 8 Drawing Sheets

(56) References Cited

U.S. PATENT DOCUMENTS

| | | | | |
|---|---|---|---|---|
| 6,003,619 | A * | 12/1999 | Lange | E21B 1/02 173/132 |
| 8,752,876 | B2 | 6/2014 | Niekamp et al. | |
| 9,238,895 | B2 | 1/2016 | Niekamp et al. | |
| 9,416,514 | B2 | 8/2016 | Niekamp et al. | |
| 2007/0137408 | A1* | 6/2007 | Lassiter | B62K 21/26 74/551.8 |
| 2009/0000799 | A1* | 1/2009 | Foster | E02D 7/08 173/128 |
| 2010/0236802 | A1* | 9/2010 | Berger | B25D 11/064 173/118 |

* cited by examiner

POST DRIVER APPARATUS

FIELD

This disclosure pertains to a post driver apparatus. More specifically, this disclosure pertains to a post driver apparatus of simplified and compact construction. The apparatus can be easily attached to a vehicle equipped with a universal quick attach hitch and having auxiliary hydraulics, for example a farm or construction vehicle. The apparatus includes a hydraulic motor that is driven by the auxiliary hydraulics of the vehicle to which the apparatus is attached. The hydraulic motor rotates a drive wheel of the apparatus which is operatively connected with a weight piston of the apparatus. Rotation of the drive wheel lifts and then drops the weight piston on each rotation of the drive wheel. With the apparatus positioned on the top end of a post, each time the weight piston is dropped it impacts the top of the post and drives the post downwardly. The apparatus is equipped with a safety feature that prevents rotation of the drive wheel from operatively raising the weight piston until the apparatus is positioned on top of a post and exerts a force on the top end of the post.

BACKGROUND

There are currently available various different types of post driver apparatus. Their constructions and operations are basically the same. They function by driving or dropping a hammer or weight against a top end of a post, and thereby driving the bottom end of the post into the ground.

Many of the current post driver apparatus have complex and/or cumbersome constructions. Their constructions make the apparatus difficult to position on a post and difficult to operate to drive the post. Many types of post drivers directly strike the top of the post with the weight which causes damage to the post while driving. In addition, post drivers that directly strike the top of the post with the weight do not securely hold the post while driving, which permits the post to move leading to "loose" posts that are not plumb.

SUMMARY

The post driver apparatus of this disclosure has a simplified construction that is easy to maneuver and operate. The apparatus can be easily attached by a universal quick attach hitch to a vehicle having an auxiliary hydraulic circuit. For example, the apparatus can be easily attached to the lift arms of a skid-steer.

The apparatus has a cylindrical housing with opposite top and bottom ends. A hollow interior bore extends through the housing between the top and bottom ends. A cylindrical sidewall surrounds the interior bore and extends along a length of the housing. A top wall of the housing closes over the hollow interior bore at the housing top end. A bottom wall having an opening extends over the hollow interior bore at the housing bottom end. The bottom wall is formed as an annular rim or flange that extends from the housing into the interior bore. The annular rim configuration of the bottom wall surrounds the opening. The opening communicates an exterior environment of the housing with the hollow interior bore through the opening. The housing also has a slot through the sidewall of the housing. The slot extends along the length of the housing and communicates the exterior environment of the housing with the hollow interior bore through the slot.

A strike plate is positioned in the housing interior bore. The strike plate lays on the annular rim bottom wall and over the opening in the bottom wall. The strike plate is free to move upwardly and downwardly a short distance in the interior bore.

A weight piston is mounted in the interior bore for reciprocating movement of the piston between a lower position and an upper position of the piston in the interior bore. In the lower position of the piston, the piston lays on the strike plate with the strike plate in turn laying on the bottom wall of the housing. The piston has a plurality of projections on a side of the piston. The plurality of projections extend through the slot in the sidewall of the housing.

A spring is positioned in the housing interior bore between the piston and the top wall of the housing. The spring urges the piston downwardly toward the lower position of the piston in the interior bore.

A shaft is mounted on the housing for rotation of the shaft. The shaft is an output shaft of a hydraulic motor. The hydraulic motor is mounted to the exterior of the housing with the shaft traversing the slot in the housing sidewall. A pair of hydraulic hoses connect the hydraulic motor to the auxiliary hydraulic circuit of the vehicle with which the apparatus is used.

A drive wheel is attached to the shaft for rotation of the drive wheel with rotation of the shaft. The drive wheel is comprised of a pair of spaced, side by side plates. The plates have circular peripheral edges that define a circular periphery of the drive wheel.

A plurality of pins are mounted on the drive wheel between the pair of plates. The plurality of pins are spatially arranged in an arc along the circular peripheral edges of the plates. The plurality of pins are arranged around less than one quarter of the drive wheel periphery.

To operate the apparatus, the auxiliary hydraulics of the vehicle to which the apparatus is attached are activated, causing the hydraulic fluid to cycle through the hydraulic motor. This results in the hydraulic motor rotating the shaft, which in turn rotates the drive wheel. With the piston positioned in the lower position of the piston in the interior bore, the rotation of the drive wheel causes the plurality of pins to pass over the plurality of projections on the piston and not engage with the plurality of projections.

The apparatus is then moved by the vehicle to the post to be driven by the apparatus. The vehicle positions the apparatus over the top end of the post and then lowers the apparatus onto the post. The top end of the post passes through the opening in the bottom wall of the housing and engages against the strike plate. Further downward movement of the apparatus onto the top end of the post causes the post to push the strike plate upwardly, which in turn pushes the piston upwardly and begins compression of the spring.

With the piston moved above the lower position of the piston, the projections on the piston are moved upwardly to a position where they can be engaged by the plurality of pins on the drive wheel. The rotation of the drive wheel causes the pins to come into engagement with the plurality of projections on the piston. Further rotation of the drive wheel causes the plurality of pins to push upwardly on the plurality of projections and move the piston upwardly through the interior bore from the strike plate adjacent the bottom end of the housing toward the top end of the housing. This movement of the piston further compresses the spring. Still further rotation of the drive wheel causes the plurality of pins to disengage from the plurality of projections, releasing the piston from its operative connection with the drive wheel. The disengagement of the plurality of pins from the projections causes the weight of the piston and the force of the spring to move the piston downwardly toward the housing bottom wall. Engagement of the piston against the strike plate exerts a force of impact on the top end of the post, driving the bottom end of the post into the ground. The continued rotation of the drive wheel sequentially raises and then releases the piston for downward movement and impact with the strike plate and the top end of the post. This cycle is repeated six times per second with the vehicle auxiliary hydraulic circuit cycling at 15 gallons per minute.

With the post driven into the ground to its desired depth, the vehicle lifts the apparatus from the driven post. Lifting the apparatus from the post causes the piston to be moved to the lower position of the piston in the interior bore. This in turn disengages the drive wheel pins from the piston projections. The vehicle is then operated to move the apparatus to the next post location.

Further features of the apparatus are disclosed in the following detailed description of the apparatus and the drawing figures.

DESCRIPTION

Figure 1:
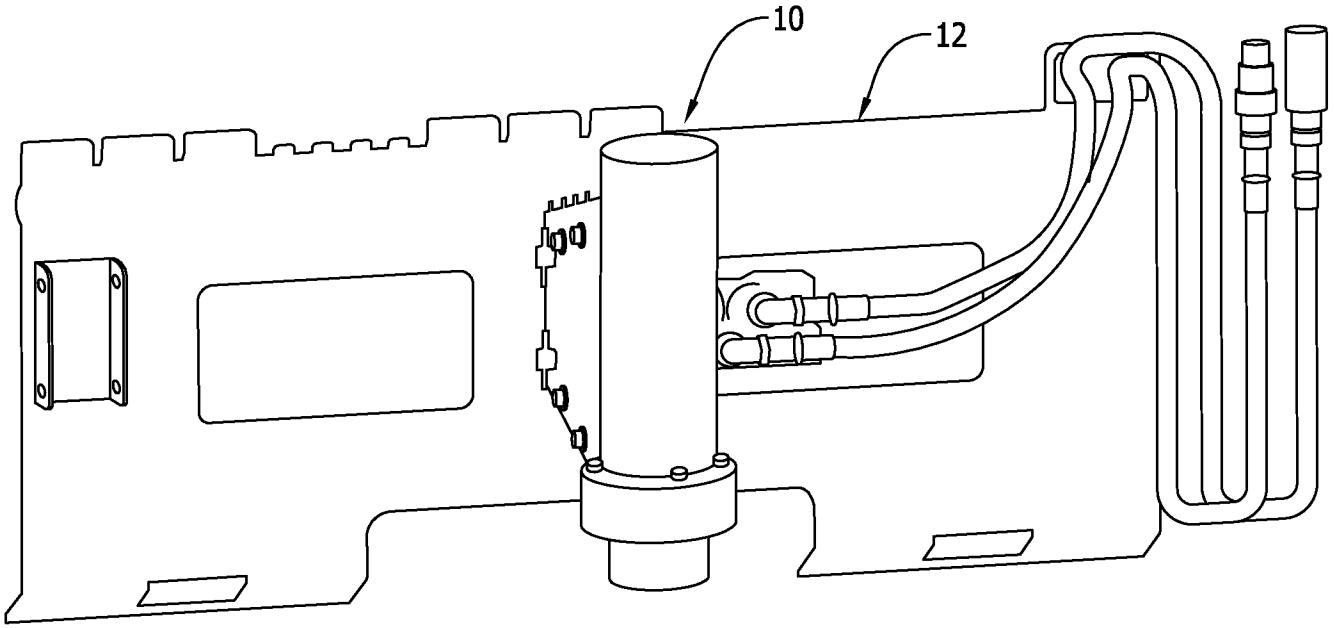
FIG. 1 is a perspective view of the post driver apparatus of this disclosure attached to a quick attach plate assembly that enables the apparatus to be attached to a vehicle having a universal quick attach hitch and auxiliary hydraulics.
Figure 2:
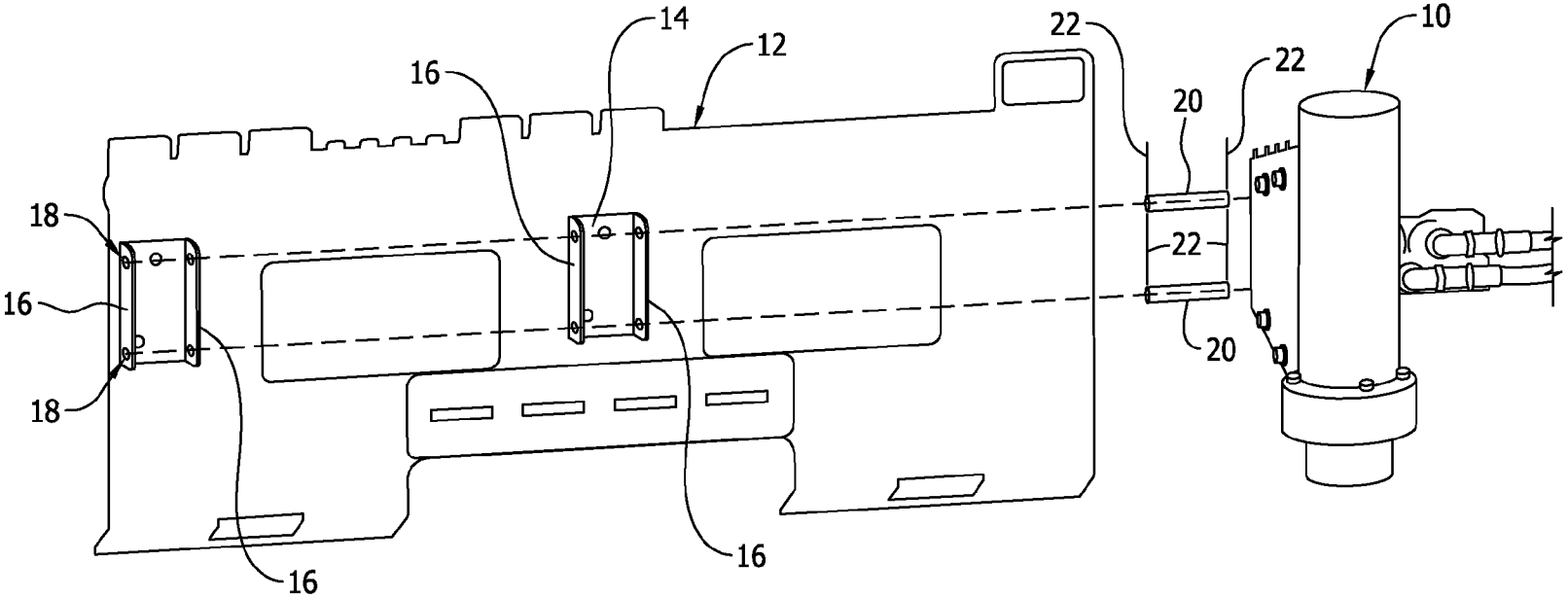
FIG. 2 is a representation of the apparatus of this disclosure being attached to the quick attach plate assembly.
Figure 4:
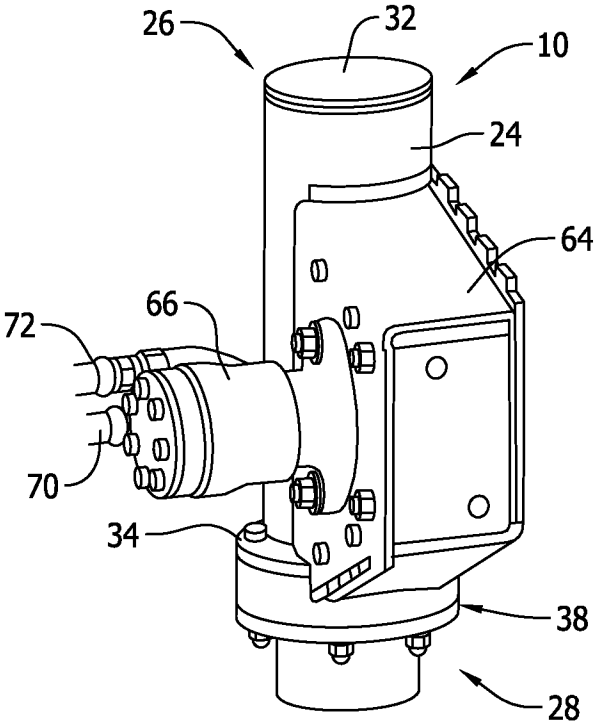
FIG. 4 is a representation of a perspective view of the right side of the apparatus shown in FIG. 5.
Figure 3:
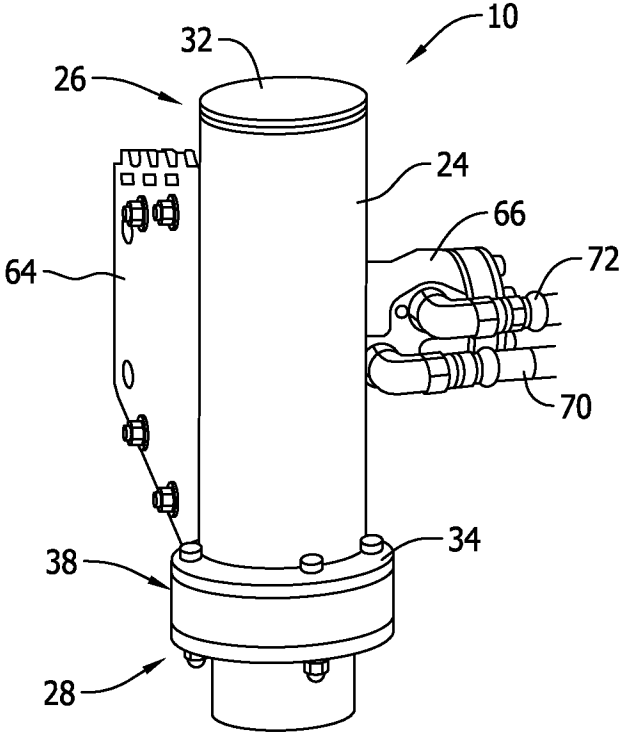
FIG. 3 is a representation of a perspective view of the left side of the apparatus removed from the quick attach plate assembly.

FIG. 1 is a representation of the post driver apparatus 10 of this disclosure attached to a quick attach plate assembly 12. The quick attach plate assembly 12 is employed to easily attach the apparatus 10 to a vehicle that is equipped with a universal quick attach hitch and auxiliary hydraulics. For example, the plate assembly 12 could be used to attach the apparatus 10 to the lift arms of a skid-steer. FIG. 2 is a representation of the process of attaching the apparatus 10 to the quick attach plate assembly 12. As represented in FIG. 2, the plate assembly 12 has a pair of brackets 14. The brackets are the same and each bracket has a pair of parallel flanges 16. The flanges have aligned pairs of holes 18 through the flanges. The apparatus 10 can be quickly attached to either of the brackets 14 by a pair of pins 20 that are inserted through aligned holes of the apparatus 10 and either of the brackets 14. The pins 20 are secured in place once installed by cotter pins or rue clips 22. The quick attach plate assembly 12 is only one means of easily attaching the apparatus 10 to the vehicle with which the apparatus is to be used. Other attachment means may be used and therefore the quick attach plate assembly 12 will not be further described herein.

Figure 5:
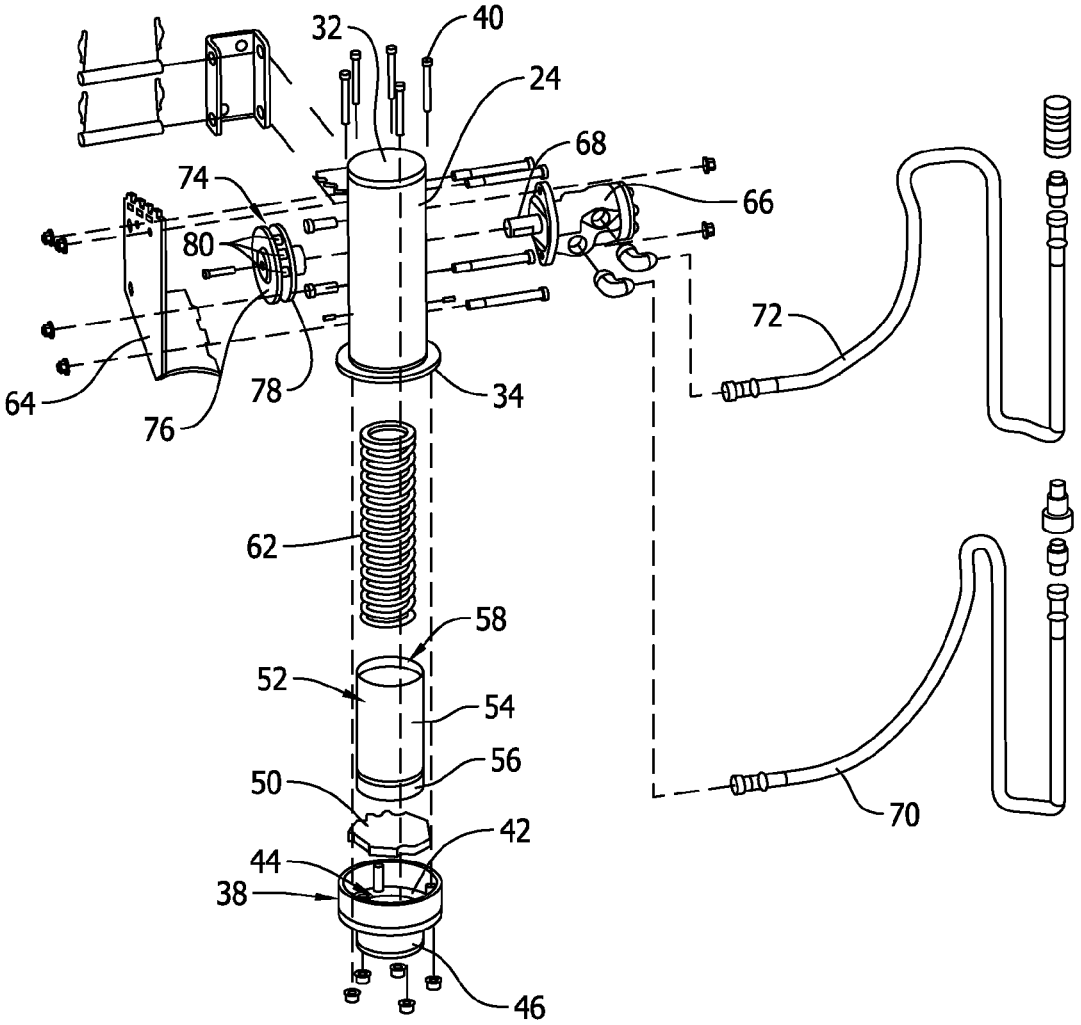
FIG. 5 is a representation of an exploded view of the apparatus component parts.
Figure 6:
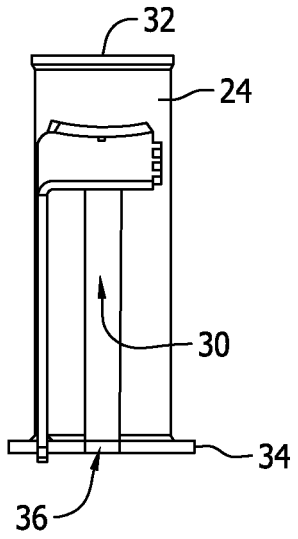
FIG. 6 is a representation of the apparatus sidewall removed from the apparatus and showing an opposite side of the sidewall not shown in FIG. 5.

Referring to FIG. 5, the apparatus 10 has a housing with a generally cylindrical configuration defined by a cylindrical sidewall 24. FIG. 6 shows the sidewall 24 removed from the apparatus 10. The view of the sidewall 24 in FIG. 6 is an opposite side of the sidewall 24 shown in FIG. 5. The sidewall 24 extends along a length of the housing between a top end 26 of the housing and a bottom end 28 of the housing. A hollow interior bore 30 extends through the housing between the housing top end 26 and the housing bottom end 28. The cylindrical sidewall 24 surrounds the interior bore 30. The housing also includes a circular top wall 32 secured to the cylindrical sidewall 24 at the top end 26 of the housing. An annular rim 34 extends around the bottom of the cylindrical sidewall 24. A slot 36 is formed through the cylindrical sidewall 24 just above the annular rim 34. The slot 36 extends upwardly from the annular rim 34 to the top wall 32 of the housing. The slot 36 communicates an exterior environment of the housing with the interior bore 30.

Figure 7:
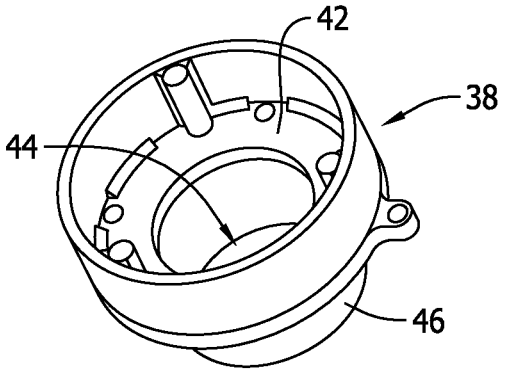
FIG. 7 is a representation of a perspective view of a foot of the apparatus removed from the apparatus.

A cylindrical foot 38 is secured to the annular rim 34 by a plurality of nut and bolt fasteners 40. FIG. 7 is a perspective view of the foot 38 removed from the apparatus 10. The cylindrical foot 38 defines the bottom of the housing and a bottom of the interior bore 30. An annular flange or annular bottom wall 42 extends inwardly into the interior bore at an intermediate portion of the cylindrical foot 38. The annular bottom wall 42 surrounds an opening 44 to the interior bore 30. The opening 44 communicates the exterior environment of the housing with the interior bore 30. A lower cylindrical portion 46 of the cylindrical foot 38 extends downwardly from an interior edge of the opening 44.

A strike plate 50 is positioned in the housing interior bore 30 adjacent the housing bottom end 28. The strike plate 50 has a peripheral edge that conforms to the interior surface of the cylindrical foot 38. This configuration of the strike plate peripheral edge enables the strike plate 50 to move through the interior bore 30 between the annular bottom wall 42 and the annular rim 34. When the apparatus 10 is not in use, the strike plate 50 lays on the annular bottom wall 42 over the opening 44 to the housing interior bore.

Figure 8:
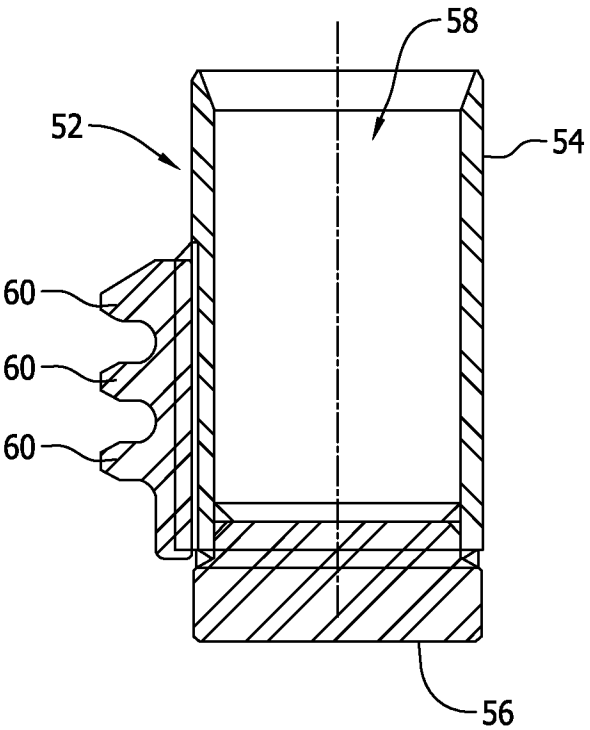
FIG. 8 is a representation of a side cross-section view of a piston of the apparatus removed from the apparatus.

A piston 52 is mounted in the housing interior bore 30 for reciprocating movements of the piston in the interior bore. FIG. 8 is a side cross-section view of the piston 52 removed from the apparatus 10. The piston 52 has a cylindrical sidewall 54 and a circular bottom head surface 56 that surround a hollow interior 58 of the piston. In a lower position of the piston 52 in the housing interior bore 30, the piston head surface 56 lays on the strike plate 50 which in turn lays on the annular bottom wall 42 of the housing. The piston has a plurality of projections 60 that project from the piston sidewall 54. The projections 60 are arranged in line on the piston sidewall 54 and project through the housing slot 36. In the embodiment of the apparatus shown in the drawing figures, there are three projections 60. However, for different sizes of apparatus 10 there could be more or fewer projections.

A coiled spring 62 is mounted in the housing interior bore 30. The spring 62 is positioned between the piston 52 and the housing top wall 32. A majority of the spring 62 is contained in the piston interior 58. The length of the spring 62 is such that, with one end of the spring engaging against the housing top wall 32 the opposite end of the spring pushes the piston head surface 56 against the strike plate 50 with the strike plate laying on the housing annular bottom wall 42.

A support structure 64 is attached to the exterior of the housing sidewall 24. As described earlier, the support structure 64 can be used to attach the apparatus 10 to the quick attach plate assembly 12. Alternatively, the support structure 64 can be used to attach the apparatus 10 to a vehicle having auxiliary hydraulics in any other equivalent manner.

A hydraulic motor 66 is attached to the support structure 64. The motor 66 has an output shaft 68 that extends from the motor and into the support structure 64. As is conventional, the hydraulic motor 66 has a supply hose 70 and a return hose 72. The hoses 70, 72 are connected to fittings of the vehicle with which the apparatus 10 is used that communicate the hydraulic motor 66 with the auxiliary hydraulic circuit of the vehicle. On operation of the auxiliary hydraulic circuit, hydraulic fluid is cycled through the motor 66 which in turn causes rotation of the motor shaft 68.

Figure 9:
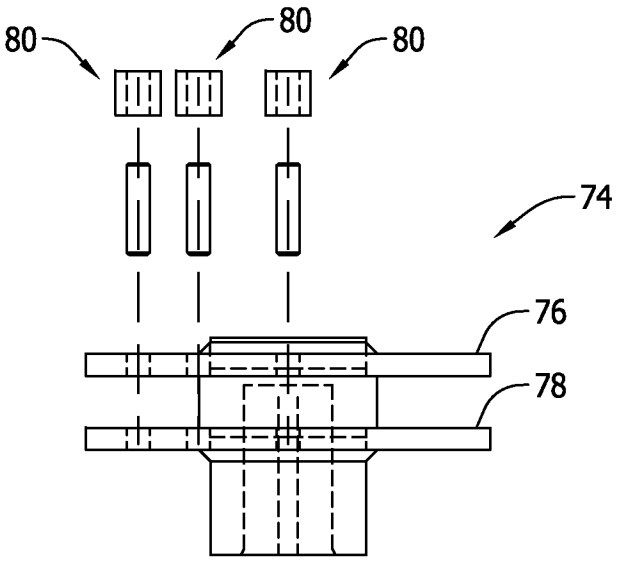
FIG. 9 is a representation of a side view of a drive wheel of the apparatus with the component parts of the drive wheel disassembled from the drive wheel.
Figure 10:
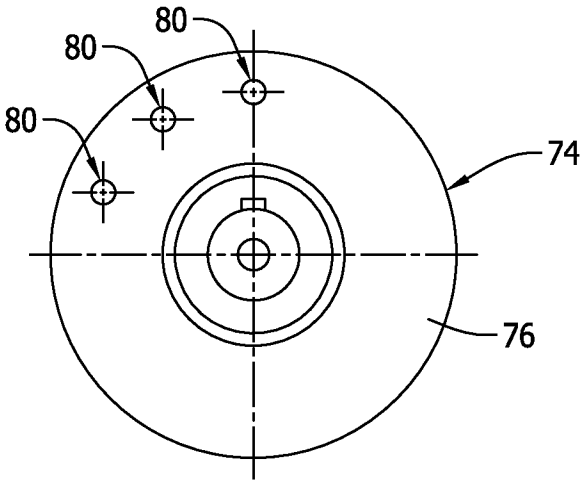
FIG. 10 is a representation of an end view of the drive wheel.

A drive wheel 74 is connected to the shaft 68 for rotation of the drive wheel with rotation of the shaft. FIGS. 9 and 10 show details of the drive wheel 74. The drive wheel 74 is comprised of a pair of spaced plates 76, 78 having circular peripheral edges. The plates 76, 78 are spaced from each other by a plurality of pin and roller assemblies 80 connected between the plates. Each pin and roller assembly 80 includes a pin and a hardened roller mounted for rotation on the pin. As shown in the drawing figures, the pin and roller assemblies 80 are arranged in an arc around a portion of the peripheral edges of the drive wheel plates 76, 78. The plurality of pin and roller assemblies 80 extend around only a fraction of the drive wheel periphery. In the embodiment shown in the drawing figures, the plurality of pin and roller assemblies 80 extends around only one quarter of the drive wheel periphery. The space between adjacent pin and roller assemblies 80 is sufficient to enable one of the piston projections 60 to extend into the space. The number of pin and roller assemblies 80 also corresponds to the number of projections 60. However, as stated earlier, different numbers of projections 60 and pin and roller assemblies 80 could be used. With the drive wheel 74 secured on the hydraulic motor shaft 68, the drive wheel 74 is positioned adjacent the housing slot 36 and the line of projections 60 on the piston 52.

Figure 11A:
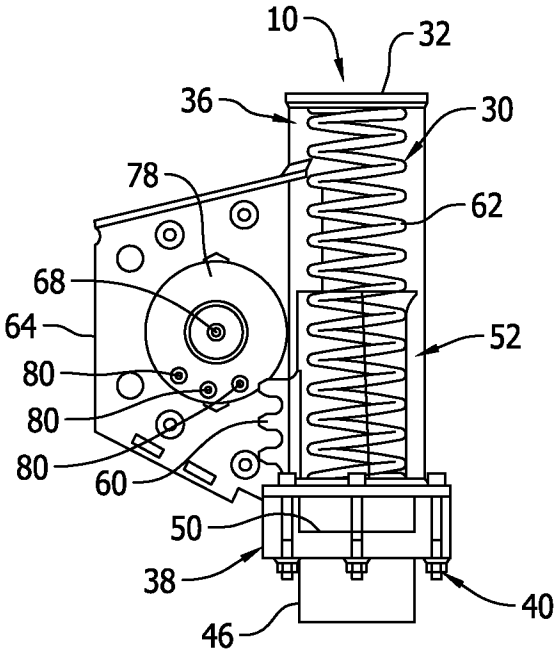
FIGS. 11A-11D are representations of side cross-section views of the apparatus during one cycle of operation of the apparatus.

Operation of the apparatus 10 is represented in FIGS. 11A-11D. To operate the apparatus 10, the hydraulic motor hoses 70, 72 are connected to the appropriate fittings on the vehicle with which the apparatus is to be used. This connects the hydraulic motor 66 in the auxiliary hydraulic circuit of the vehicle. The auxiliary hydraulic circuit of the vehicle is then activated, causing the hydraulic fluid to cycle through the hydraulic motor 66. This results in the hydraulic motor 66 rotating the shaft 68, which in turn rotates the drive wheel 74. As viewed in FIGS. 11A-11D, the rotation of the drivel wheel 74 is counter clockwise. With the piston 52 being pressed against the strike plate 50 by the spring 62, the rotation of the drive wheel 74 causes the plurality of pin and roller assemblies 80 to move over the plurality of projections 60 on the piston and not engage with the plurality of projections. This is represented in FIG. 11A.

Figure 11D:
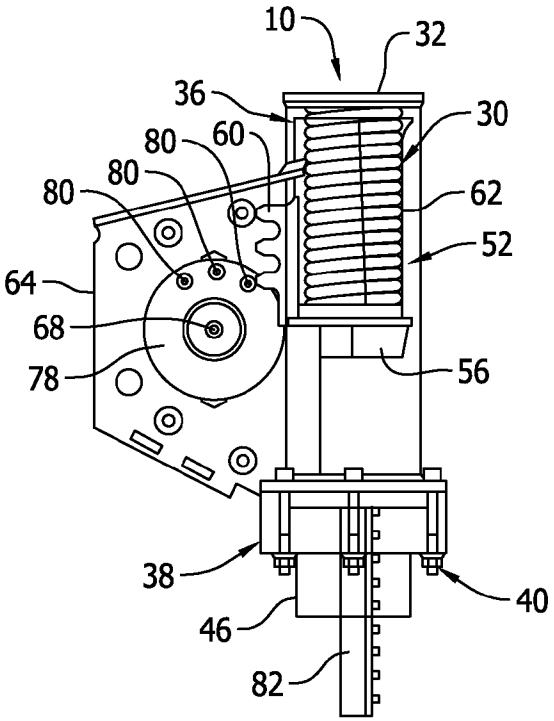
Figure 11C:
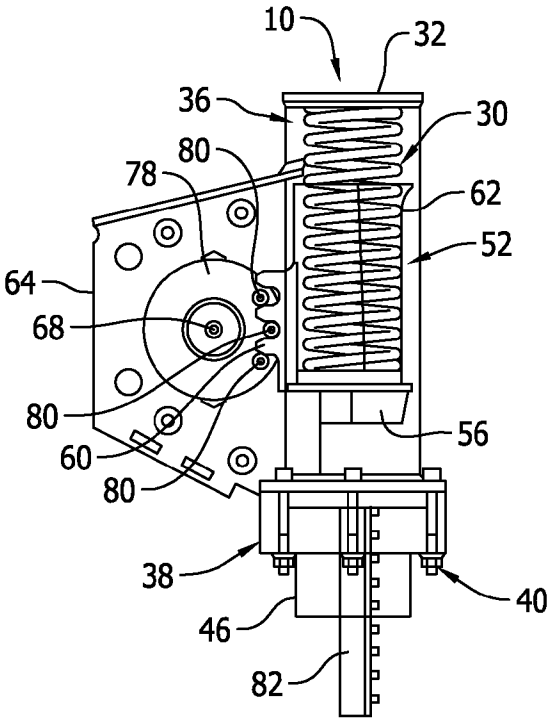
Figure 11B:
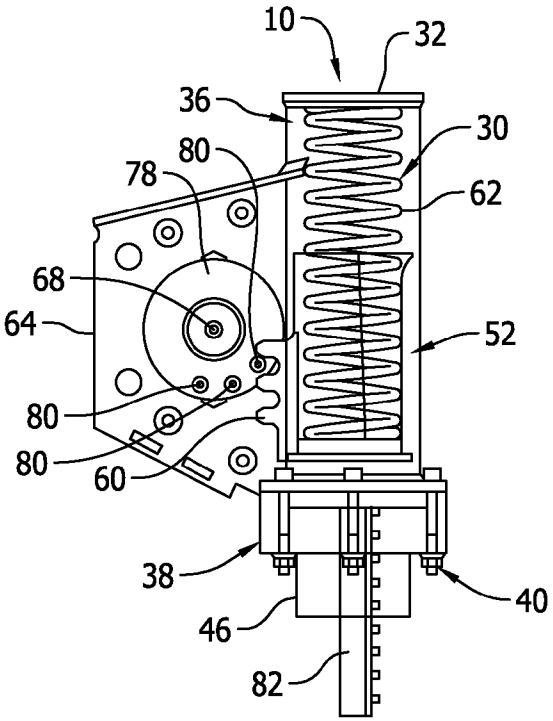

The apparatus 10 is then moved by the operator of the vehicle to the post to be driven by the apparatus. The vehicle lift arms position the apparatus 10 over the top end of the post 82 and then lower the apparatus onto the post 82 as represented in FIG. 11B. The top end of the post 82 passes through the opening 44 in the housing bottom wall 42 and engages against the strike plate 50. Further downward movement of the apparatus by the vehicle lift arms onto the top end of the post 82 causes the post to push the strike plate 50 upwardly through the housing interior bore 30. This movement of the strike plate 50 pushes the piston 52 upwardly in the housing interior bore 30 and begins compression of the spring 62. Movement of the strike plate 50 in the cylindrical foot 38 is limited between the annular bottom wall 42 and the annular rim 34. This enables the apparatus 10 to utilize the weight of the vehicle to which it is attached to assist in driving the post 82. After the operator has lowered the apparatus 10 onto the post 82, continued lowering of the apparatus 10 onto the post 82 transfers the weight of the vehicle onto the top of the post 82. This, depending on the vehicle weight, can result in considerable force being applied to the post 82 prior to activating the apparatus 10.

With the piston 52 being raised above the lower position of the piston in the interior bore 30, the projections 60 on the piston are moved upwardly to a position where they can be engaged by the plurality of pin and roller assemblies 80 on the drive wheel 74. This is represented in FIG. 11B. The rotation of the drive wheel 74 causes the pin and roller assemblies 80 to come into engagement with the plurality of projections 60 on the piston 52. Further rotation of the drive wheel 74 causes the plurality of pin and roller assemblies 80 to push upwardly on the plurality of projections 60 and move the piston upwardly through the housing interior bore 30 from the strike plate 50 toward the top end 26 of the housing as represented in FIG. 11C. This movement of the piston 52 further compresses the spring 62. Still further rotation of the drive wheel 74 causes the plurality of pin and roller assemblies 80 to disengage from the plurality of projections 60, releasing the piston 52 from its operative connection with the drive wheel 74. This is represented in FIG. 11D. The disengagement of the plurality of pin and roller assemblies 80 from the piston projections 60 causes the weight of the piston 52 and the force of the spring 62 to move the piston 52 downwardly toward the strike plate 50. Engagement of the piston circular head surface 56 with the strike plate 52 exerts a force of impact on the top end of the post 82, driving the bottom end of the post into ground. The continued rotation of the drive wheel 74 sequentially raises and then releases the piston for downward movement and impact with the strike plate 50 and the top end of the post 82. This cycle is repeated six times per second with the vehicle auxiliary hydraulic circuit cycling at fifteen gallons per minute.

With the post 82 driving into the ground to its desired depth, the vehicle operator then lifts the lift arms of the vehicle and the apparatus 10 from the driven post. Lifting the apparatus 10 from the post 82 allows the strike plate 50 to lay on the housing bottom wall 42 and causes the piston to be moved to the lower position of the piston in the interior bore 30 of the housing. This in turn positions the piston projections 60 where the drive wheel pin and roller assemblies 80 will pass over the projections on rotation of the drive wheel 74. The vehicle operator then operates the vehicle to move the apparatus 10 to the next post location.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

The invention claimed is:

1. A post driver apparatus comprising:

a housing having a length with a top end and an opposite bottom end and an interior bore extending through the housing between the top end and the bottom end, the housing having a too wall at the top end of the housing, the housing having an opening at the bottom end, the opening providing access to the interior bore from an exterior environment of the housing through the opening;

a piston mounted in the interior bore for reciprocating movement of the piston through the interior bore, the piston having a plurality of projections on a side of the piston;

a shaft mounted on the housing for rotation of the shaft;

a drive wheel attached to the shaft for rotation of the drive wheel with rotation of the shaft;

a spring in the interior bore between the top end of the housing and the piston, the spring having a lent with one end of the spring engaging against the top wall of the housing and an opposite end of the spring engaging with the piston and urging the piston to move through the interior bore from adjacent the too end of the housing toward the bottom end of the housing;

a plurality of pins on the drive wheel, the plurality of pins being positioned on the dive wheel where, with the piston position in the interior bore adjacent the bottom end of the housing, rotation of the drive wheel causes the pins to come into engagement with the plurality of projections on the piston, where further rotation of the drive wheel causes the plurality of pins to push upwardly on the plurality of projections and move the piston through the interior bore from adjacent the bottom end of the housing toward the top end of the housing and where still further rotation of the drive wheel causes the plurality of pins to disengage from the plurality of projections causing the spring to move the piston through the interior bore from adjacent the top end of the housing toward the bottom end of the housing;

the piston having a hollow interior and a top opening; and, the length of the spring extending from the one end of the spring in the interior bore of the housing, through the top opening and to the opposite end of the spring in the hollow interior of the piston.

2. The apparatus of claim 1, further comprising:

the plurality of pins being equal in number to the plurality of projections.

3. The apparatus of claim 1, further comprising:

the piston having a top end and an opposite bottom end; and, the plurality of projections being positioned on the side of the piston adjacent the bottom end of the piston.

4. The apparatus of claim 1, further comprising:

the plurality of projections being arranged on the side of the piston in a line extending along the side of the piston.

5. The apparatus of claim 1, further comprising:

the shaft being an output shaft of a motor; and, the motor being mounted on the housing.

6. The apparatus of claim 1, further comprising:

the motor being a hydraulic motor.

7. The apparatus of claim 1, further comprising:

the drive wheel having a circular peripheral edge; and, the plurality of pins being spatially arranged along the drive wheel peripheral edge.

8. The apparatus of claim 7, further comprising:

the plurality of pins being spatially arranged along less than one half of the drive wheel peripheral edge.

9. The apparatus of claim 7, further comprising:

the plurality of pins being spatially arranged along less than one quarter of the drive wheel peripheral edge.

10. The apparatus of claim 1, further comprising:

a flange on the housing, the flange extending into the interior bore adjacent the opening of the housing;

a strike plate in the interior bore, the strike plate being free to move through the interior bore, the strike plate laying on the flange and extending over the opening of the housing; and, the piston being positioned in the interior bore above the strike plate where, with the strike plate laying on the flange and the piston laying on the strike plate, the plurality of pins on the drive wheel will not engage the plurality of projections on the piston with rotation of the drive wheel.

11. A post drive apparatus comprising:

a housing having a length with a top end and an opposite bottom end and an interior bore extending through the housing between the top end and the bottom end, the housing having a top wall at the top end of the housing, the housing having an opening at the bottom end of the housing, the opening providing access to the interior bore from an exterior environment of the housing through the opening, the housing having a flange in the interior bore and adjacent the opening of the housing;

a piston mounted in the interior bore for reciprocating movement of the piston between a lower position and an upper position of the piston in the interior bore, the flange preventing downward movement of the piston past the lower position of the piston in the interior bore, the piston having a plurality of projections on a side of the piston;

a shaft mounted on the housing for rotation of the shaft;

a drive wheel attached to the shaft for rotation of the drive wheel with rotation of the shaft;

a spring in the interior bore between the piston and the top end of the housing, the spring having a length with one end of the spring engaging against the top wall of the housing and an opposite end of the spring engaging with the piston and urging the piston toward the bottom end of the housing;

a plurality of pins on the drive wheel, the plurality of pins being positioned on the drive wheel where, with the piston position in the lower position of the piston in the interior bore, rotation of the drive wheel causes the plurality of pins to pass over the plurality of projections on the piston and not engage with the plurality of projections, the piston having a hollow interior and a top opening; and, the length of the spring extending from the one end of the spring in the interior bore of the housing, through the top opening and to the opposite end of the spring in the hollow interior of the piston.

12. The apparatus of claim 11, further comprising:

the plurality of pins being positioned on the drive wheel where, with the piston being moved upwardly in the interior bore to a position of the piston in the interior bore above the lower position of the piston in the interior bore, rotation of the drive wheel causes the plurality of pins to come into engagement with the plurality of projections on the piston.

13. The apparatus of claim 12, further comprising:

the plurality of pins being positioned on the drive wheel where further rotation of the drive wheel causes the plurality of pins to push upwardly on the plurality of projections and move the piston through the interior bore from adjacent the bottom end of the housing toward the top end of the housing.

14. A apparatus of claim 13, further comprising:

the plurality of pins being positioned on the drive wheel where still further rotation of the drive wheel causes the plurality of pins to disengage from the plurality of projections causing the spring to move the piston through the interior bore from adjacent the top end of the housing toward the bottom end of the housing.

15. The apparatus of claim 11, further comprising:

the plurality of pins being equal in number to the plurality of projections.

16. The apparatus of claim 11, further comprising:

the drive wheel having a circular peripheral edge; and, the plurality of pins being spatially arranged in an arc adjacent the circular peripheral edge of the drive wheel.

17. The apparatus of claim 16, further comprising:

the plurality of pins extending along less than one half of the peripheral edge of the drive wheel.

18. The apparatus of claim 11, further comprising:

the drive wheel being comprised of a pair of spaced plates having circular peripheral edges, the pair of plates being spaced from each other by the plurality of pins, each pin of the plurality of pins having a roller mounted on the pin for rotation of the roller on the pin.

* * * * *